US006057522A

United States Patent [19]

Chao

[11] Patent Number: 6,057,522

[45] Date of Patent: May 2, 2000

[54] KEYSWITCH OF MULTIPLE-WIDTH KEY

[75] Inventor: Shih-Hung Chao, Taoyuan, Taiwan

[73] Assignee: Acer Peripherals Inc., Taoyuan, Taiwan

[21] Appl. No.: 09/192,985

[22] Filed: Nov. 16, 1998

[30] Foreign Application Priority Data

May 26, 1998 [TW] Taiwan ..... 87208173

[51] Int. Cl.[7] ..... H01H 13/70

[52] U.S. Cl. ..... 200/344; 200/341

[58] Field of Search ..... 200/341–344; 400/491, 491.1, 491.2

[56] References Cited

U.S. PATENT DOCUMENTS 4,771,146 9/1988 Suzuki et al. ..... 200/340

5,878,872 3/1999 Tsai ..... 200/344

*Primary Examiner*—Michael L. Gellner

*Assistant Examiner*—Nhung Nguyen

*Attorney, Agent, or Firm*—Majestic, Parsons, Siebert & Hsue P.C.

[57] ABSTRACT

A keyswitch including a keycap, a switch element, a rubber sheet, a housing, a balance lever is provided. The switch element, responsive to the reciprocal movement of the keycap, selectively turns ON. The rubber sheet is disposed on the switch element. The housing includes a pair of hook devices. The hook device and the housing constitutes a slot. A opening is provided on the housing at location corresponding to the hook device. The balance lever includes a longitudinal portion connected to two traverse portions forming an "U" shape. The end of the traverse portion is disposed into the slot corresponding to the hook device. A protrusion is provided integrally on the rubber sheet at location corresponding to the hook device. The protrusion passed the opening and contacts with the end terminals of the traverse portions of the balance lever to lower the noise.

6 Claims, 3 Drawing Sheets

FIG._1B
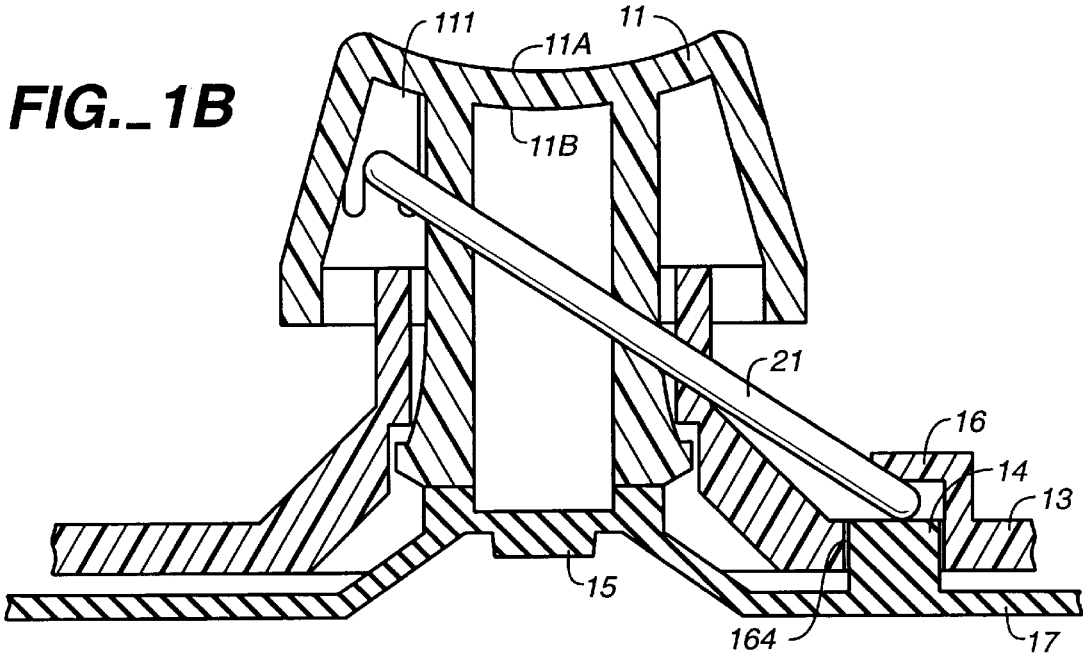
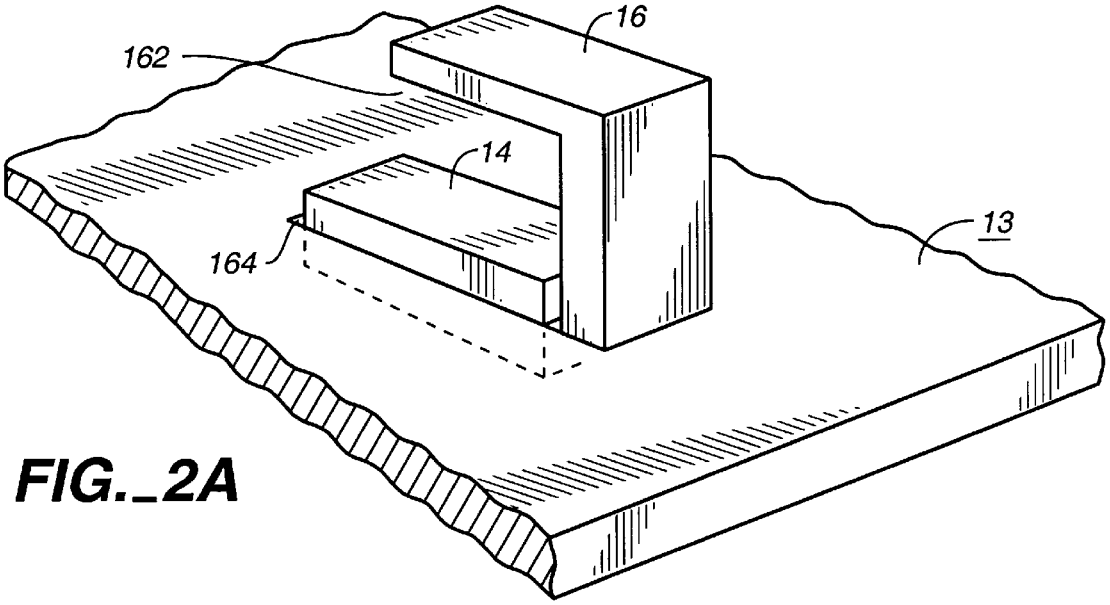
FIG._2A
FIG._2B
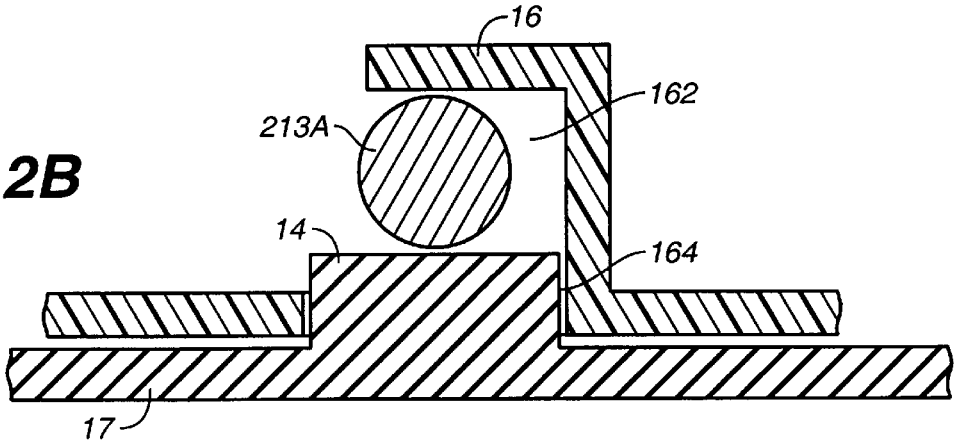

KEYSWITCH OF MULTIPLE-WIDTH KEY

FIELD OF INVENTION

The invention relates to the keyswitch of a multiple-width key of a keyboard.

BACKGROUND OF INVENTION

The keyboard device for computer or electric typewriter in general includes a plurality of Alpha-Numeric keys of square-form keycap. The keycap for some small amount of keyswitches. e.g. the "SPACE bar" key, the "Enter", the "CAPs LOCK" and the "SHIFT" key, have a width multiple to that of the square type keycap. The keyswitch of the type is called as the multiple-width key.

As well known in the arts, the conventional multiple-width key includes a balance lever. Since the multiple-width key has a longer width as mentioned earlier, without the provision of the balance level, the multiple-width key will experience a tilt condition when the finger-tip force is applied at the location other than the center of the keycap. With the balance lever in the multiple-width key, though the fingertip force is applied at the location other than the center of the keycap, no tilt condition is observed. However, to assemble the components of the keyswitch, the dimension tolerance must be provided. Nevertheless, the provided tolerance between different components creates undesired movement or swing of the keycap relative to the horizontal surface. As a result, during the operation of the multiple-width keys, noise due to the reciprocal movement of the keycap is generated.

SUMMARY OF INVENTION

To solve the mentioned noise associating with the operation of the multiple-width key, the invention provides a new structure of multiple-width key which substantially reduces the noise.

The keyswitch includes a keycap, a switch element, a rubber sheet, a housing and a balance lever.

The switch element, responsive to the reciprocal movement of the keycap, selectively turns ON. The rubber sheet is disposed on the switch element.

The housing has a pair of hook devices formed thereon to constitute a slot respectively. An opening is formed on the housing at the location substantially under the slot.

The balance lever has a longitudinal portion connected to two traverse portions forming an "U" shape. And an end terminal of each traverse portion is disposed within the slot corresponding to one hook device.

A protrusion is formed on the rubber sheet at location corresponding to the slot. The protrusion extends into the opening and contacts with the end terminal of the traverse portion of the balance lever to lower the noise generated during movement of the traverse portion.

BRIEF DESCRIPTION OF THE DRAWINGS

The present invention may readily be understood by the following descriptions together with the accompanying drawings, in which:

FIG. 1(B) shows the sectional view of the first embodiment in FIG. 1(A).

FIG. 2(A) shows the enlargement view of the hook device 16 in FIG. 1(A).

FIG. 2(B) shows the sectional view at the location of hook device 16 in accordance with the first embodiment.

DETAILED DESCRIPTIONS OF THE INVENTION

Figure 1A:
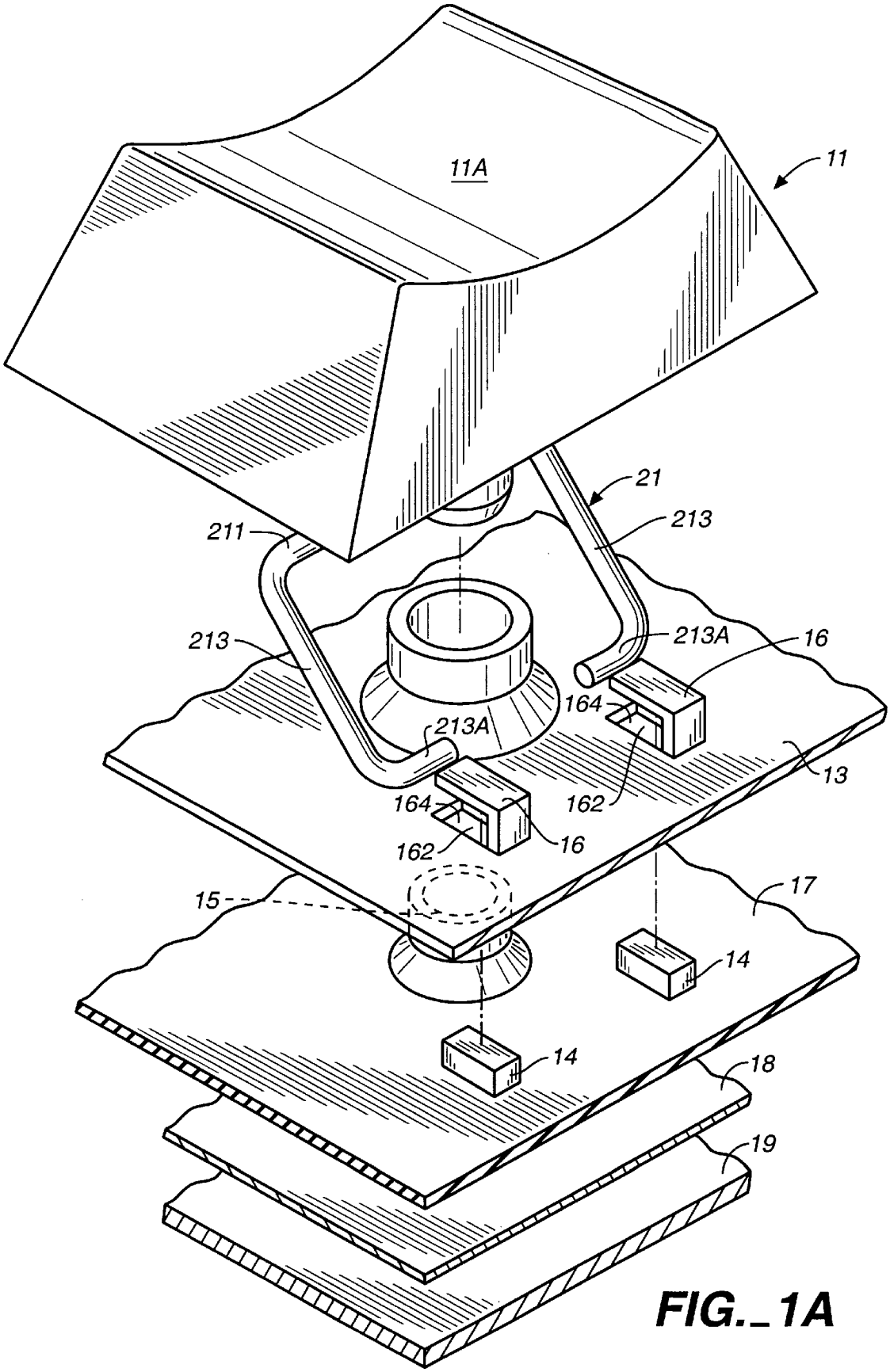
FIG. 1(A) shows the first embodiment of the invention in explosive view.

Referring to FIG. 1(A) and FIG. 1(B), the keyswitch of the multiple-width of the invention includes a keycap 11, a housing 13, an elastic element 15, a membrane switch 18, a balance lever 21 and a baseplate 19. Same as the conventional approach, a rubber sheet 17 is provided over the top of the membrane switch 18. At a location corresponding to each keycap 11, a rubber dome 15 on the rubber sheet 17 is provided as the elastic element 15. As the keyswitch is depressed, the rubber dome 15 deforms downwardly. As the keyswitch is released, the rubber dome 15 supplies an elastic force to push the keycap 11 upward. A pair of hook devices 16 are formed on the housing 13 to constitute a slot 162 defined by the hook device 16 and the housing 13. An opening 164 is formed on the housing 13 at the location substantially under the slot 162 corresponding to the hook device 16. The membrane switch 18, responsive to the reciprocal movement of the keycap 11, selectively turns ON. The balance lever 21 has a longitudinal portion 211 connected to two traverse portions 213 forming an "U" shape balance lever. The end terminal 213A of each traverse portion 213 is disposed within the slot 162 corresponding to one hook device 16. The keycap 11 includes a top surface 11A and a bottom surface 118. As shown in FIG. 1(B), the bottom surface 118 of the keycap 11 provides a pair of engagement portions 111 and the longitudinal portion 211 of the balance lever 21 engages with the pair of engagement portions 111. Therefore, as shown in FIG. 1(A) and (B), the pair of hook devices 16 function to engage with the end terminal 213A of the traverse portions 213 of the balance lever 21 preventing the detachment of the balance lever 21 from the housing 13. During the reciprocal movement of the keycap 11, the longitudinal portion 211 rotates within the space defined by the engagement portion 111 and the ends of two traverse portions 213 respectively slide within the slot 162 defined by the hook device 16.

As shown in FIG. 2(A) and FIG. 1(B), a protrusion 14 is formed on the rubber sheet 17 at location corresponding to the slot 162. The protrusion 14 extends into the opening 164 and contacts with the end terminal 213A of the traverse portions 213 of the balance lever 21, as shown in FIG. 2(B), to lower the noise generated during movement of the traverse portions 213.

In other words, during the reciprocal movement of the multiple-width key, the end terminal 213A of traverse portions 213 does not impact onto the surface of housing 13, as illustrated in FIG. 2(B), and the noise level is substantially reduced to half.

Figure 3:
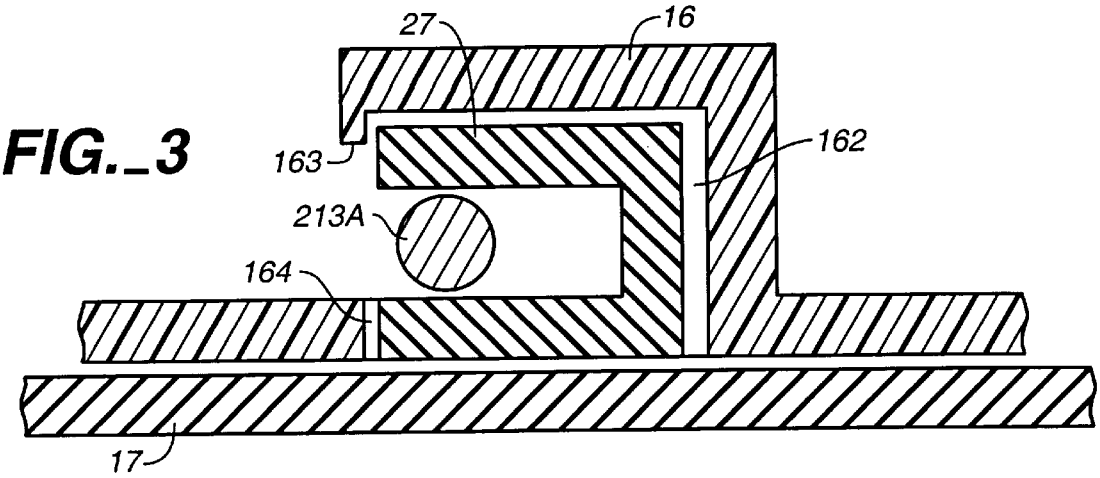
FIG. 3 shows the sectional view at the location of hook device 16 in accordance with the second embodiment.

Referring to the second embodiment illustrated in FIG. 3, before the assembly of the balance lever 21, one may insert one rubber article of "U" shape into the slot 162 corresponding to the hook device 16. Afterwards, the balance lever 21 is disposed therein. Furthermore, a projection 163 is provided at an end of the hook device 16 for retaining the protrusion 27 within the hook device 16. FIG. 3 shows the section view after assembly. In this embodiment, the balance lever 21 only contacts with the rubber article 27 during the reciprocal movement of the keycap and therefore the noise is minimized. It is to be noted that the rubber article 27 is separate from the rubber sheet 17.

Figure 4A:
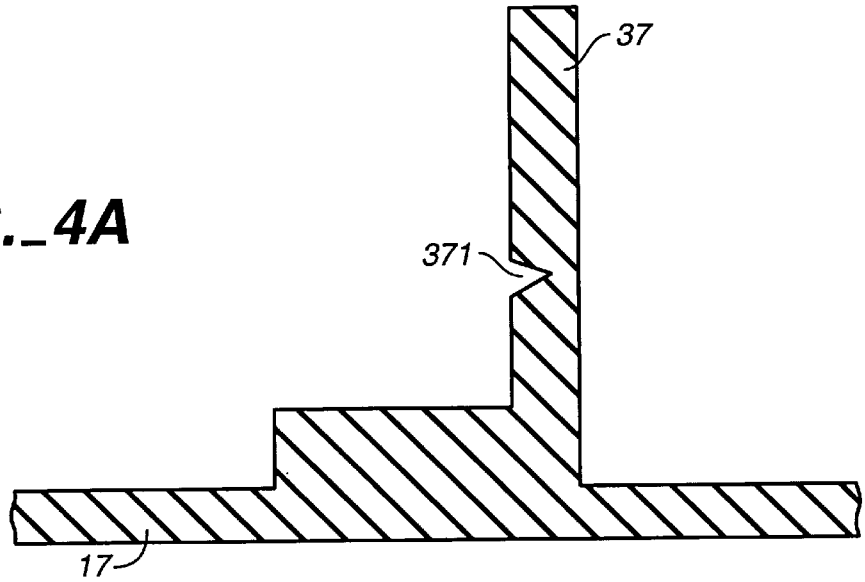
FIG. 4(A) shows the original status of the protrusion 37 in accordance with the third embodiment.
Figure 4B:
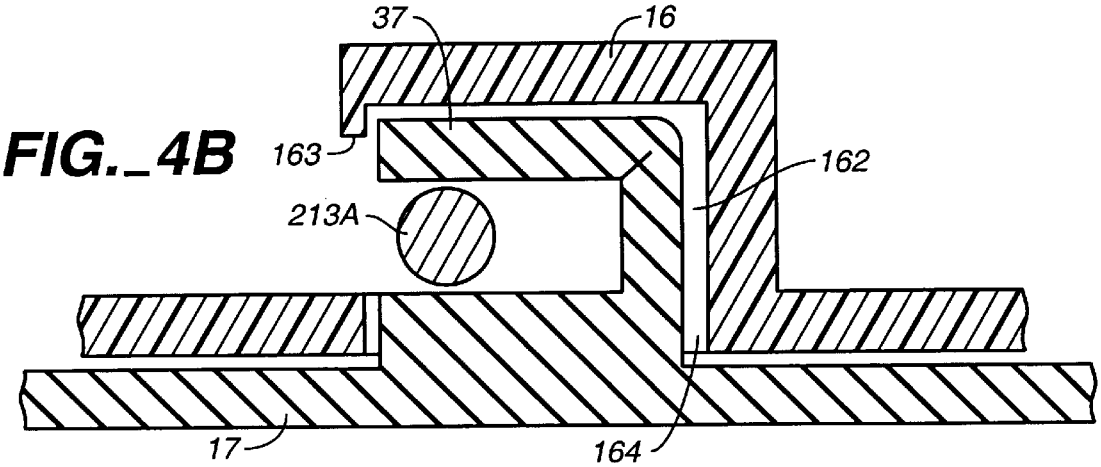
FIG. 4(B) shows the sectional view at the location of hook device 16 after the keyswitch of third embodiment is assembled.

The third embodiment of the invention is shown in FIGS. 4(A) and 4(B). During the forming of the rubber sheet 17, a protrusion 37 is also formed integrally at location corresponding to the hook device 16. A notch 371 is provided at the side of the protrusion 37 such that the protrusion 37 easily bends towards the side of slot 162 and forms the "U" shape during assembly. Furthermore, a projection 163 is provided at an end of the hook device 16 for retaining the protrusion 37 within the hook device 16. During the assembly process the protrusion 37 is bent, and the final status after assembly process is shown in FIG. 4(B). The space defined by the protrusion 37 in its deflection shape allows the passage of the end terminal 213A of the traverse portion 213 of balance lever 21. Comparing FIG. 3 and 4, it is known that the protrusion 37 is integral with the rubber sheet 17 in FIG. 4 and this embodiment simplifies the production step.

I claim:

1. A keyswitch, comprising:

a keycap;

a switch element, responsive to the reciprocal movement of the keycap, for selectively being turned ON;

a rubber sheet disposed on the switch element;

a housing disposed on the rubber sheet, said housing having a pair of hook devices formed thereon to define slots and having openings formed at locations substantially under the respective slots; and a balance lever having a longitudinal portion connected to two traverse portions forming an "U" shape, wherein end terminals of the traverse portions are disposed within the respective slots;

further wherein protrusions are formed on the rubber sheet at locations corresponding to the respective slots, said protrusions extending into the respective openings and contacting with the respective end terminals of the traverse portions of the balance lever to lower the noise generated during movement of the traverse portions.

2. The keyswitch of claim 1, the keycap including a top surface and a bottom surface, the bottom surface providing a pair of engagement portions, the longitudinal portion of the balance lever engages with the pair of engagement portions.

3. A keyswitch, comprising:

a keycap;

a switch element, responsive to the reciprocal movement of the keycap, for selectively being turned ON;

a rubber sheet disposed on the switch element;

a housing disposed on the rubber sheet, said housing having a pair of hook devices formed thereon to define slots and having openings formed at locations substantially under the respective slots; and a balance lever having a longitudinal portion connected to two traverse portions forming an "U" shape, wherein end terminals of the respective traverse portions are disposed within the respective slots;

further wherein "U" shape absorbers are provided at locations corresponding to the respective slots, said "U" shape absorbers contacting with the respective end terminals of the traverse portions of the balance lever to lower the noise generated during movement of the traverse portions, and further wherein the "U" shape absorbers are separate elements from the rubber sheet.

4. A keyswitch, comprising:

a keycap;

a switch element, responsive to the reciprocal movement of the keycap, for selectively being turned ON;

a rubber sheet disposed on the switch element;

a housing disposed on the rubber sheet, said housing having a pair of hook devices formed thereon to define slots and having openings formed at locations substantially under the respective slots; and a balance lever having a longitudinal portion connected to two traverse portions forming an "U" shape, wherein end terminals of the respective traverse portions are disposed within the respective slots;

further wherein protrusions are integrally formed on the rubber sheet at locations corresponding to the respective slots, said protrusions extending into the respective openings and contacting with the respective end terminals of the traverse portions of the balance lever and thereby having an "U" shape after assembly with the housing to lower the noise generated during movement of the traverse portions.

5. The keyswitch of claim 4, wherein a notch is provided at a side of each of the protrusions such that each of the protrusions is easily bended to form the "U" shape during assembly.

6. The keyswitch of claim 4, wherein a projection is provided at an end of each of the hook devices for retaining the protrusion within the hook device.

* * * * *